US010634355B2

(12) United States Patent
Prociw et al.

(10) Patent No.: US 10,634,355 B2
(45) Date of Patent: Apr. 28, 2020

(54) DUAL FUEL RADIAL FLOW NOZZLES

(71) Applicant: Delavan Inc, West Des Moines, IA (US)

(72) Inventors: Lev Alexander Prociw, Johnston, IA (US); Jason A. Ryon, Carlisle, IA (US)

(73) Assignee: Delavan Inc., West Des Moines, IA (US)

( * ) Notice: Subject to any disclaimer, the term of this patent is extended or adjusted under 35 U.S.C. 154(b) by 566 days.

(21) Appl. No.: 15/382,044

(22) Filed: Dec. 16, 2016

(65) Prior Publication Data

US 2018/0172274 A1 Jun. 21, 2018

(51) Int. Cl.

| | |
|---|---|
| ***F23R 3/14*** | (2006.01) |
| ***F23R 3/34*** | (2006.01) |
| ***F23R 3/28*** | (2006.01) |
| ***F23R 3/36*** | (2006.01) |
| ***F23R 3/10*** | (2006.01) |

(Continued)

(52) U.S. Cl.

CPC ..... *F23R 3/286* (2013.01); *F23D 11/107* (2013.01); *F23D 11/383* (2013.01); *F23D 17/002* (2013.01); *F23R 3/10* (2013.01); *F23R 3/14* (2013.01); *F23R 3/346* (2013.01); *F23R 3/36* (2013.01)

(58) Field of Classification Search

CPC .. F23R 3/14; F23R 3/283; F23R 3/286; F23R 3/346; F23R 3/36; F23R 3/10; F23R 3/12; F23R 3/28; F23D 11/107; F23D 11/383; F23D 17/002; F23D 11/104; F23D 14/24; F23D 2204/10; F23C 7/004; F23C 2201/30; F23C 2201/301; F23C 7/002; F02C 7/2365; F02C 7/222

USPC ..... 239/398, 399, 400, 402, 405, 406, 418, 239/422, 423, 424

See application file for complete search history.

(56) References Cited

U.S. PATENT DOCUMENTS 3,937,011 A * 2/1976 Caruel ..... F23D 11/107 60/737
5,505,045 A * 4/1996 Lee ..... F23D 11/107 239/424

(Continued)

FOREIGN PATENT DOCUMENTS

EP 3076083 A1 10/2016

OTHER PUBLICATIONS

European Extended Search Report of the European Patent Office, dated Apr. 20, 2018, issued in corresponding European Patent Application No. 17207794.3.

*Primary Examiner* — Scott J Walthour
*Assistant Examiner* — Todd N Jordan
(74) *Attorney, Agent, or Firm* — Locke Lord LLP; Scott D. Wofsy; Joshua L. Jones

(57) ABSTRACT

A nozzle includes a nozzle body defining a longitudinal axis. The nozzle body includes an inner air passage fed by a radial swirler and having a converging conical cross-section. A first fuel circuit is radially outboard from the air passage with respect to the longitudinal axis. A second fuel circuit is radially outboard from the first fuel circuit with respect to the longitudinal axis, wherein each of the first fuel circuit and the second fuel circuit extends from a respective fuel circuit inlet to a respective annular fuel circuit outlet. An outer air passage is defined between a fuel circuit outer wall and an outer air passage wall, wherein the outer air passage is a converging non-swirling outer air passage.

14 Claims, 3 Drawing Sheets

(51) Int. Cl.

| | |
|---|---|
| ***F23D 11/10*** | (2006.01) |
| ***F23D 17/00*** | (2006.01) |
| ***F23D 11/38*** | (2006.01) |

(56) References Cited

U.S. PATENT DOCUMENTS

| | | | | |
|---|---|---|---|---|
| 6,272,840 | B1 * | 8/2001 | Crocker | F02C 7/22<br>239/404 |
| 7,454,914 | B2 * | 11/2008 | Prociw | F23D 11/105<br>29/889.2 |
| 9,188,063 | B2 * | 11/2015 | Prociw | F23R 3/28 |
| 9,222,673 | B2 * | 12/2015 | Boardman | F23D 3/14 |
| 2014/0338342 | A1 * | 11/2014 | Graham | F23R 3/28<br>60/740 |
| 2016/0290649 | A1 | 10/2016 | Prociw | |

* cited by examiner

DUAL FUEL RADIAL FLOW NOZZLES

BACKGROUND OF THE INVENTION

1. Field of the Invention

The present disclosure relates to nozzles, and more particularly to nozzles for multiple fuels such as used in industrial gas turbine engines.

2. Description of Related Art

Dual fuel capability does not easily lend itself to low emissions. In conventional dual fuel nozzles, e.g., for industrial gas turbine engines, liquid fuel is usually injected from a pressure atomizer located along the center line of a nozzle. It is difficult in conventional nozzles to get the liquid fuel to the outer reaches of the fuel nozzle, especially in large diameter nozzles.

The conventional techniques have been considered satisfactory for their intended purpose. However, there is an ever present need for improved dual fuel nozzles. This disclosure provides a solution for this problem.

SUMMARY OF THE INVENTION

A nozzle includes a nozzle body defining a longitudinal axis. The nozzle body includes an inner air passage fed by a radial swirler and having a converging conical cross-section. A first fuel circuit is radially outboard from the air passage with respect to the longitudinal axis. A second fuel circuit is radially outboard from the first fuel circuit with respect to the longitudinal axis, wherein each of the first fuel circuit and the second fuel circuit extends from a respective fuel circuit inlet to a respective annular fuel circuit outlet. An outer air passage is defined between a fuel circuit outer wall and an outer air passage wall, wherein the outer air passage is a converging non-swirling outer air passage.

At least one of the first and second fuel circuits includes a plurality of helical passages, wherein each helical passage opens tangentially with respect to the respective fuel circuit outlet. The helical passages can define a flow exit angle relative to the longitudinal axis of at least 85°. An ignitor can be located in an upstream wall of the nozzle body, oriented concentrically on the longitudinal axis.

The second fuel circuit can be defined between a fuel circuit outer wall and an intermediate fuel circuit wall, wherein the first fuel circuit is defined between a fuel circuit inner wall and the intermediate fuel circuit wall, wherein the intermediate fuel circuit wall is radially outboard from the inner fuel circuit wall with respect to the longitudinal axis, and wherein the outer fuel circuit wall is radially outboard of the intermediate fuel circuit wall with respect to the longitudinal axis. It is contemplated that the respective annular fuel circuit outlets of the first and second fuel circuits can be separated from one another by only the intermediate fuel circuit wall. At least a portion of each of the fuel circuit inner, outer, and intermediate walls can have a conical shape that converges toward the longitudinal axis.

The fuel circuit inlet of the first fuel circuit can include a plurality of circumferentially spaced apart openings for fluid communication with a fuel manifold, and the fuel circuit inlet of the second fuel circuit can include a plurality of circumferentially spaced apart openings for fluid communication with the fuel manifold. The radial swirler can include radial swirl vanes circumferentially spaced apart from one another about an annular inner air inlet, wherein the nozzle body includes a plurality of tubes, each connecting the circumferentially spaced apart openings. The tubes for both the first and second fuel circuits can pass axially through the radial swirl vanes.

A first set of the tubes can connect the circumferentially spaced apart openings of the first fuel circuit and can pass axially through the second fuel circuit. A second set of the tubes can connect the circumferentially spaced apart openings of the second fuel circuit and can pass axially through respective vanes of the radial swirler. Each tube in the first set of tubes can pass through a respective one of the tubes in the second set of tubes.

The inner air passage, outer air passage, first fuel circuit, and second fuel circuit can be configured for diffusion flame injection without pre-mixing within the nozzle body. The inner air passage can be free from obstructions along the longitudinal axis downstream of the radial swirler. The second fuel circuit can be configured for injection of liquid fuel, and the first fuel circuit can be configured for injection of gaseous fuel.

In another aspect, a nozzle includes a nozzle body defining a longitudinal axis and including first and second airflow passages and first and second fuel flow circuits, both of the airflow passages and both of the fuel flow circuits being defined at least in part between pairs of frustoconical walls, the airflow passages and fuel flow circuits being positioned in order of upstream to downstream, as determined by fluid flowing axially through the nozzle, in the order of first airflow passage, first fuel flow circuit, second fuel flow circuit, and second airflow passage, the first airflow passage being fed air through first swirling vanes configured to swirl air flowing therethrough, and the second airflow passage being fed air through second vanes not configured to swirl air flowing therethrough.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
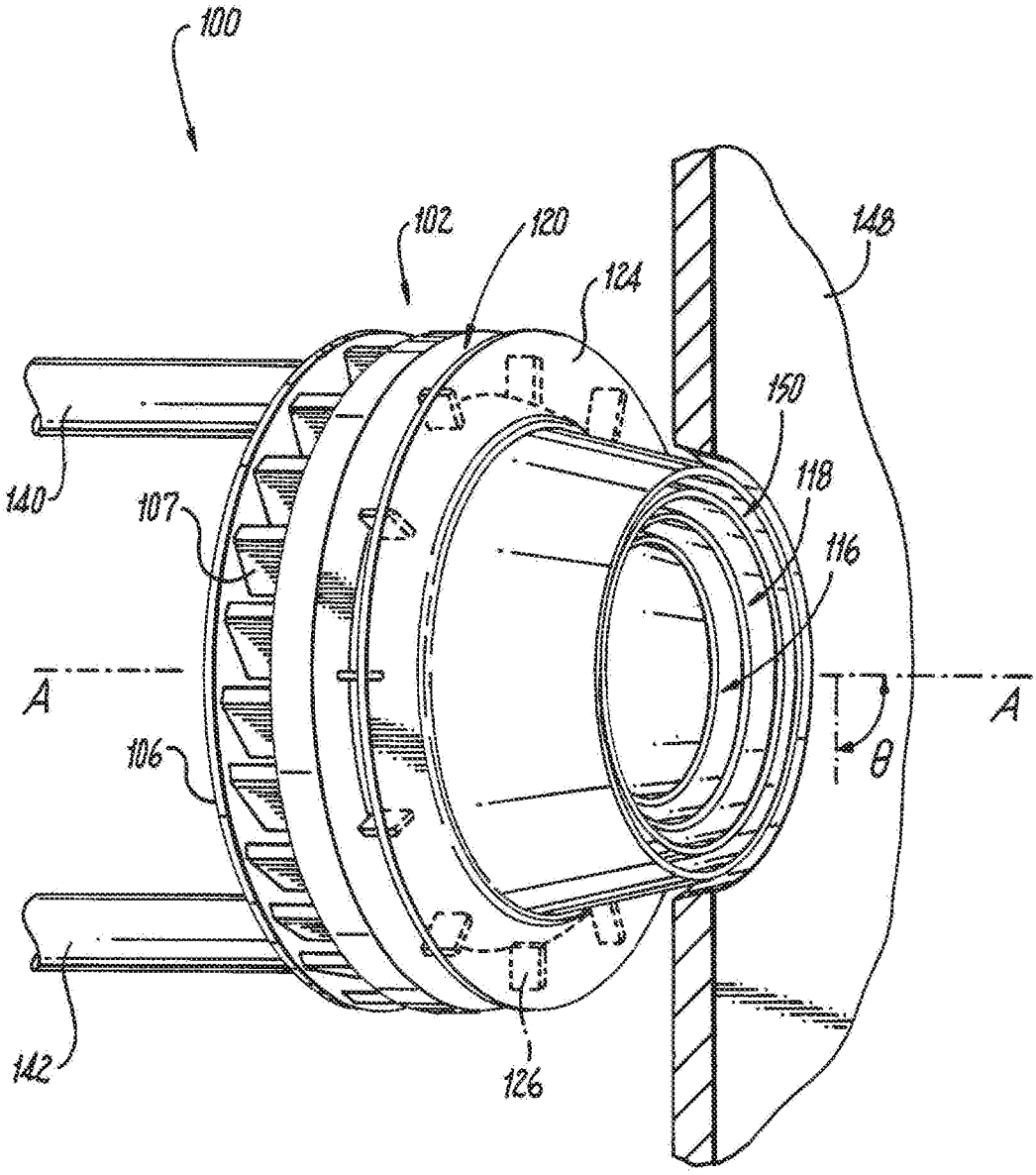
FIG. 1 is a perspective view of an exemplary embodiment of a nozzle constructed in accordance with the present disclosure, showing the radial swirler vanes for the inner air passage and the non-swirling standoffs for the outer air passage.

Reference will now be made to the drawings wherein like reference numerals identify similar structural features or aspects of the subject disclosure. For purposes of explanation and illustration, and not limitation, a partial view of an exemplary embodiment of a nozzle in accordance with the disclosure is shown in FIG. 1 and is designated generally by reference character 100. Other embodiments of nozzles in accordance with the disclosure, or aspects thereof, are provided in FIGS. 2-3, as will be described. The systems and methods described herein can be used to provide dual fuel combustion in gas turbine engines, so for example industrial gas turbine engines can use liquid and/or gaseous fuel and can switch between or apportion between liquid and gaseous fuels on demand. U.S. patent application Ser. No. 14/674,580 filed Mar. 31, 2015 is incorporated by reference herein in its entirety.

Nozzle 100 includes a nozzle body 102 defining a longitudinal axis A. The nozzle body 102 includes an inner air passage 104 fed by a radial swirler 106, e.g., a first of two air passages feeding into inner air passage 104, and having a converging conical cross-section, as shown in cross-section in FIG. 2. A first fuel circuit 108 is radially outboard from the air passage 104 with respect to the longitudinal axis A. A second fuel circuit 110 is radially outboard from the first fuel circuit 108 with respect to the longitudinal axis A. Each of the first fuel circuit 108 and the second fuel circuit 110 extends from a respective fuel circuit inlet 112 and 114 to a respective annular fuel circuit outlet 116 and 118. An outer air passage 120, e.g., a second of two air passages feeding into inner air passage 104, is defined between a fuel circuit outer wall 122 and an outer air passage wall 124, wherein the outer air passage 120 is a converging non-swirling outer air passage. Spacers 126 connect fuel circuit outer wall 122 and outer air passage wall 124 and provide space therebetween for outer air passage 120, but spacers 126 are not angled for swirl so that air flow through outer air passage 120 is not swirled.

Each of the first and second fuel circuits 108 and 110 includes a respective plurality of helical passages 128 and 130, wherein each helical passage opens tangentially with respect to the respective fuel circuit outlet 116 and 118. The helical passages 130 can define a flow exit angle θ (identified in FIG. 1) relative to the longitudinal axis A of at least 85°.

Figure 2:
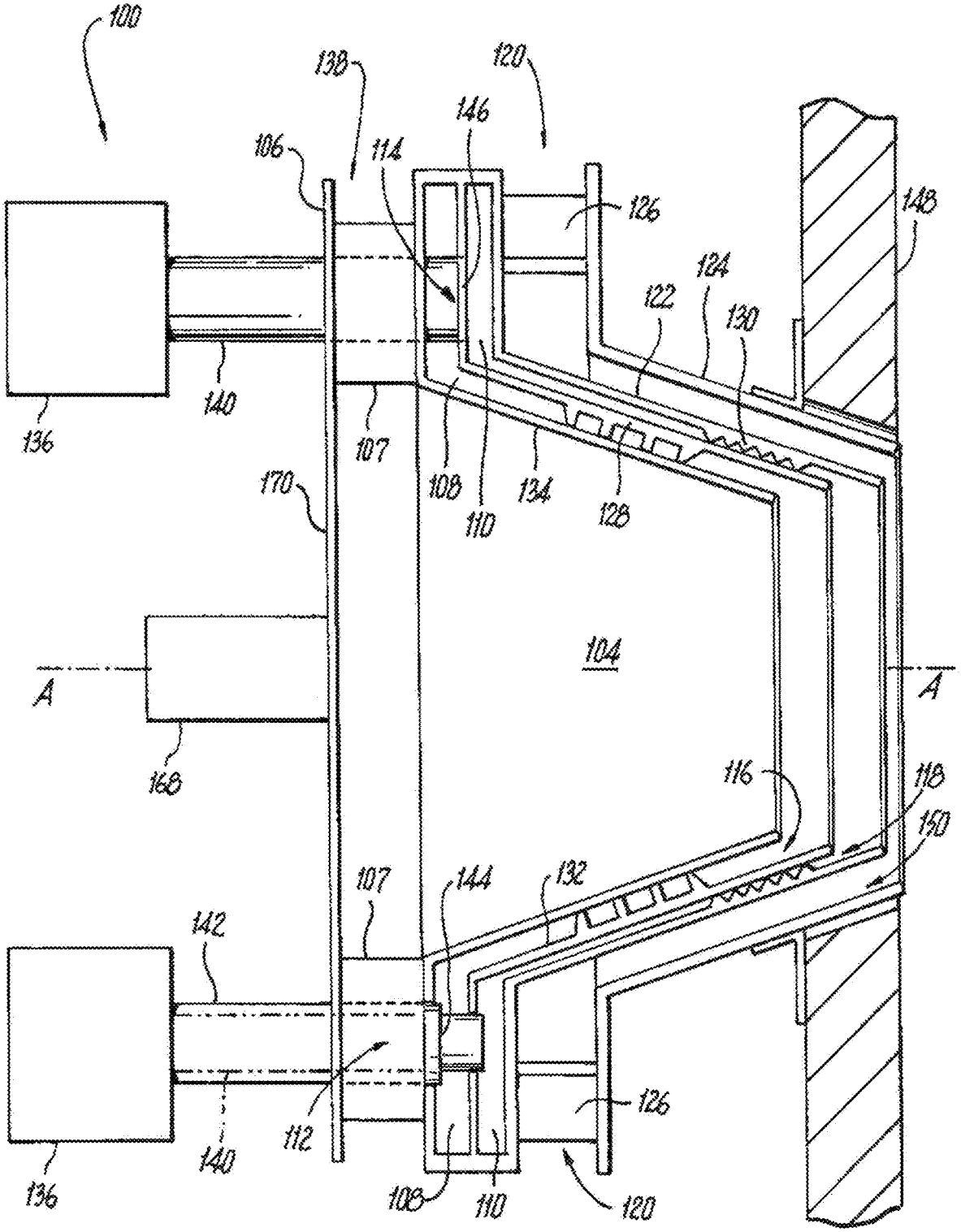
FIG. 2 is a schematic side-elevation cross-sectional view of the nozzle of FIG. 1, showing the first and second fuel circuits.

The second fuel circuit 110 is defined between the fuel circuit outer wall 122 and an intermediate fuel circuit wall 132, and the first fuel circuit 108 is defined between a fuel circuit inner wall 134 and the intermediate fuel circuit wall 132. The intermediate fuel circuit wall 132 is radially outboard from the inner fuel circuit wall 134 with respect to the longitudinal axis A, and the outer fuel circuit wall 122 is radially outboard of the intermediate fuel circuit wall 132 with respect to the longitudinal axis A. It is contemplated that the respective annular fuel circuit outlets 116 and 118 of the first and second fuel circuits 108 and 110 are separated from one another by only the intermediate fuel circuit wall 132 so that whether fuel is issued from the first or second fuel circuit 108 or 110, or both, the fuel is issued from nearly the same annular location. As shown in FIG. 2, a downstream portion of each of the fuel circuit inner, outer, and intermediate walls 134, 132, and 122 has a conical, e.g., frustoconical, shape that converges toward the longitudinal axis A. Similarly, outer air passage wall 124 has a downstream portion with a conical shape that converges toward the longitudinal axis A.

The second fuel circuit 110 can be configured for injection of liquid fuel, and the first fuel circuit 108 can be configured for injection of gaseous fuel, for example. Manifold 136 can therefore be a dual fuel manifold for supplying separate types of fuel, e.g., liquid and gaseous, to the separate fuel circuits 108 and 110. The fuel circuit inlet 112 of the first fuel circuit 108 can include one or more circumferentially spaced apart openings 144 for fluid communication with the fuel manifold 136, and the fuel circuit inlet 114 of the second fuel circuit 110 can include one or more circumferentially spaced apart openings 146 for fluid communication with the fuel manifold 136. The radial swirler 106 includes radial swirl vanes 107 circumferentially spaced apart from one another about an annular inner air inlet 138. The nozzle body includes a plurality of tubes 140 and 142. Each respective tube 140 and 142 connects a respective one of the circumferentially spaced apart openings 144 and 146 to the manifold 136. The tubes 140 and 142 for both the first and second fuel circuits 108 and 110 pass axially through respective ones of the radial swirl vanes 107, so vanes 107 can act as heat shields for the fuel tubes 140 and 142. Optionally, one or more tubes 140 can connect the circumferentially spaced apart openings 146 of the second fuel circuit 110 to the manifold 136 and can pass axially through the first fuel circuit 108 while being fluidly isolated from first fuel circuit 108 so fuels from the two fuel circuits 108 and 110 do not mix. One or more tubes 142 can connect the circumferentially spaced apart openings 144 of the second fuel circuit 108 to the manifold 136 and can pass axially through respective vanes 107 of the radial swirler. Optionally, as indicated by the tube 142 in broken lines in FIG. 2, one or more tubes 140 can pass through a respective one of the tubes 142 without mixing of fuels from the two fuel circuits 108 and 110.

Figure 3:
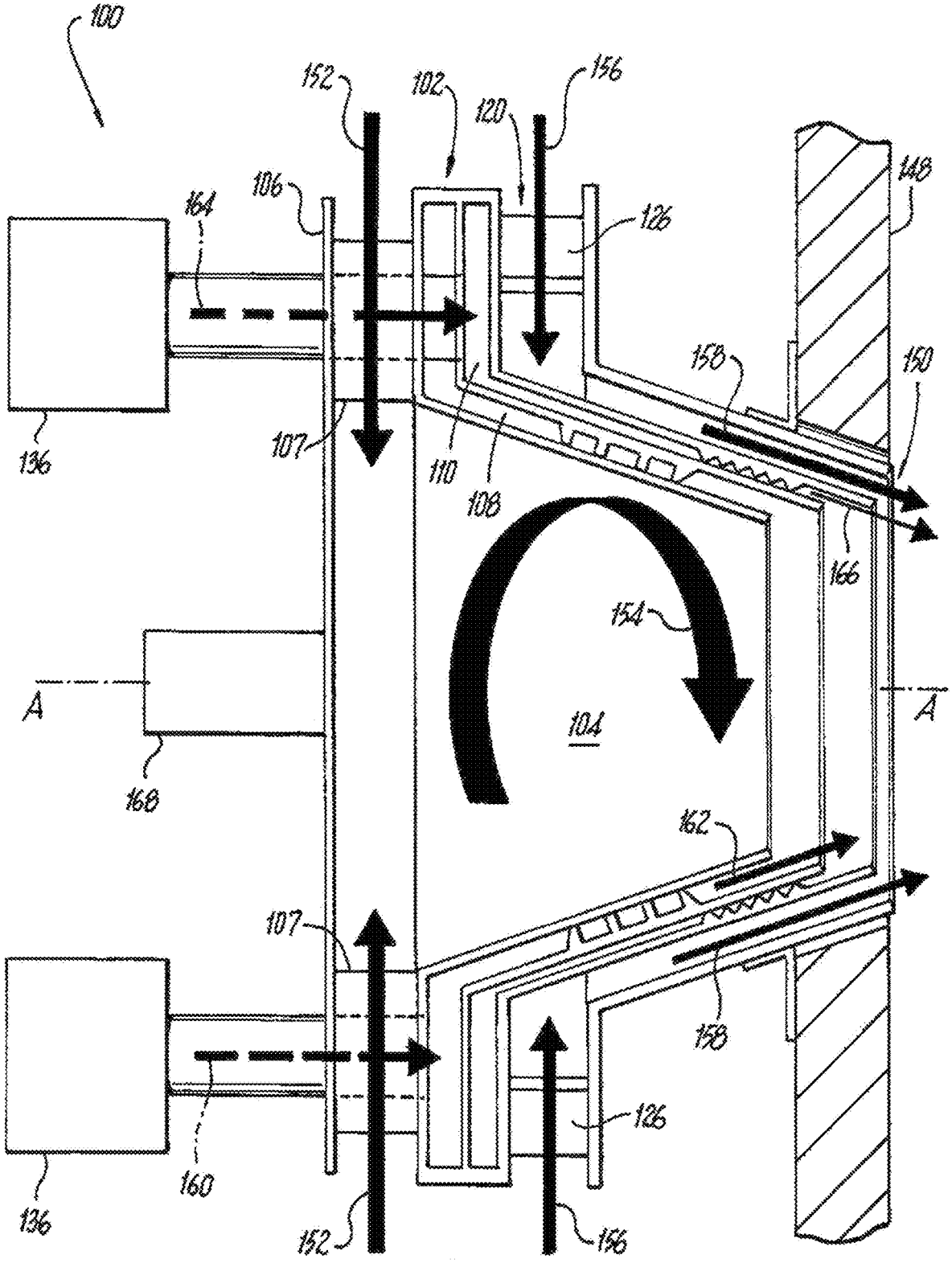
FIG. 3 is a schematic side-elevation cross-sectional view of the nozzle of FIG. 1, showing flow arrows to indicate flow through the air passages and fuel circuits.

With reference now to FIG. 3, the inner air passage 104, outer air passage 120, first fuel circuit 108, and second fuel circuit 110 are configured for diffusion flame injection, i.e., without pre-mixing within the nozzle body 102 so that the flame resides downstream of combustor dome wall 148, and the respective outlets 116 and 118 as well as the outlet 150 of the outer air circuit 120. The inner air passage 104 is free from obstructions, such as pilot injectors or the like, along the longitudinal axis A downstream of the radial swirler 106. In FIG. 3, arrows 152 and 154 indicate air flow through inner air circuit 104, arrows 156 and 158 indicate air flow through outer air circuit 120, arrows 160 and 162 indicate fuel flow through first fuel circuit 108, and arrows 164 and 166 indicate fuel flow through second fuel circuit 110. The outer air flow issued from outer air passage 120 converges and is not swirled. The inner air flow from inner air passage 104 diverges and is swirled. Air fuel mixing occurs downstream of the nozzle 100 in a non-premixed fashion. The mixing zone created by nozzle 100 permits rapid mixing of fuel and air downstream of nozzle 100.

Since the inlets of both the inner and outer air passages 104 and 120 both open toward the radial direction, both can utilize radial air feeds. This permits less pressure drop in turning the air flow into the nozzle 100, e.g. in a reverse flow combustor. Mixing level can be controlled by adjusting the diameter of the fuel distributors, e.g. the diameter of outlets 116 and 118, to suit the air flow required for a given mixing level.

The swirling air core of inner air passage 104 can supply between 40% to 50% of the air flow through nozzle 100, which is larger than in conventional nozzles. As shown in FIG. 2, an optional ignitor 168 can be included in the upstream wall 170 of nozzle body 102, oriented concentrically along the longitudinal axis A, for start up.

The methods and systems of the present disclosure, as described above and shown in the drawings, provide for dual fuel injection with superior properties including diffusion flame injection with potentially large diameter injectors, and consistent flame regardless of how the two fuels are apportioned, with low emissions. Embodiments as disclosed herein can be used as retrofit nozzles to replace conventional nozzles in combustor domes. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A nozzle comprising:

a nozzle body defining a longitudinal axis and including:

an inner air passage fed by a radial swirler and having a converging conical cross-section;

wherein the radial swirler includes radial swirl vanes circumferentially spaced apart from one another about an annular inner air inlet;

a first fuel circuit radially outboard from the inner air passage with respect to the longitudinal axis;

a second fuel circuit radially outboard from the first fuel circuit with respect to the longitudinal axis, wherein each of the first fuel circuit and the second fuel circuit extends from a respective fuel circuit inlet to a respective annular fuel circuit outlet;

wherein the fuel circuit inlet of the first fuel circuit includes a first plurality of circumferentially spaced apart openings for fluid communication with a fuel manifold, and wherein the fuel circuit inlet of the second fuel circuit includes a second plurality of circumferentially spaced apart openings for fluid communication with the fuel manifold;

wherein the nozzle body includes a plurality of tubes, a first set of the plurality of tubes connecting the first plurality of circumferentially spaced apart openings, a second set of the plurality of tubes connecting the second plurality of circumferentially spaced apart openings, wherein the first set of the plurality of tubes and the second set of the plurality of tubes pass axially through the radial swirl vanes; and an outer air passage defined between a fuel circuit outer wall of the second fuel circuit and an outer air passage wall, wherein the outer air passage is a converging non-swirling outer air passage.

2. The nozzle as recited in claim 1, wherein at least one of the first fuel circuit or the second fuel circuit includes a plurality of helical passages, wherein each helical passage opens tangentially with respect to the respective annular fuel circuit outlet.

3. The nozzle as recited in claim 2, wherein the plurality of helical passages define a flow exit angle relative to the longitudinal axis of at least 85°.

4. The nozzle as recited in claim 1, wherein the second set of the plurality of tubes pass axially through the first fuel circuit.

5. The nozzle as recited in claim 1, wherein the inner air passage, the outer air passage, the first fuel circuit, and the second fuel circuit are configured for diffusion flame injection without pre-mixing within the nozzle body.

6. The nozzle as recited in claim 1, wherein the inner air passage is free from obstructions along the longitudinal axis downstream of the radial swirler.

7. The nozzle as recited in claim 1, wherein the second fuel circuit is configured for injection of liquid fuel.

8. The nozzle as recited in claim 1, wherein the first fuel circuit is configured for injection of gaseous fuel.

9. The nozzle as recited in claim 1, wherein an ignitor is located in an upstream wall of the nozzle body, oriented coaxially with the longitudinal axis.

10. A nozzle comprising:

a nozzle body defining a longitudinal axis and including:

an inner air passage fed by a radial swirler and having a converging conical cross-section;

a first fuel circuit radially outboard from the inner air passage with respect to the longitudinal axis;

a second fuel circuit radially outboard from the first fuel circuit with respect to the longitudinal axis, wherein each of the first fuel circuit and the second fuel circuit extends from a respective fuel circuit inlet to a respective annular fuel circuit outlet;

wherein the second fuel circuit is defined by a fuel circuit outer wall of the second fuel circuit and an intermediate fuel circuit wall, and wherein the first fuel circuit is defined by a fuel circuit inner wall of the first fuel circuit and the intermediate fuel circuit wall, wherein the intermediate fuel circuit wall is radially outboard from the fuel circuit inner wall of the first fuel circuit with respect to the longitudinal axis, and wherein the outer fuel circuit wall of the second fuel circuit is radially outboard of the intermediate fuel circuit wall with respect to the longitudinal axis.

11. The nozzle as recited in claim 10, wherein the respective annular fuel circuit outlets of the first fuel circuit are separated from the respective annular fuel circuit outlets of the second fuel circuit only by the intermediate fuel circuit wall.

12. The nozzle as recited in claim 10, wherein at least a portion of each of the fuel circuit inner wall of the first fuel circuit, the fuel circuit outer wall of the second fuel circuit, and the intermediate fuel circuit wall has a conical shape that converges toward the longitudinal axis.

13. A nozzle comprising:

a nozzle body defining a longitudinal axis and including:

an inner air passage fed by a radial swirler and having a converging conical cross-section, wherein the radial swirler includes radial swirl vanes circumferentially spaced apart from one another about an annular inner air inlet;

a first fuel circuit radially outboard from the inner air passage with respect to the longitudinal axis;

a second fuel circuit radially outboard from the first fuel circuit with respect to the longitudinal axis, wherein each of the first fuel circuit and the second fuel circuit extends from a respective fuel circuit inlet to a respective annular fuel circuit outlet, wherein the fuel circuit inlet of the first fuel circuit includes a first plurality of circumferentially spaced apart openings for fluid communication with a fuel manifold, and wherein the fuel circuit inlet of the second fuel circuit includes a second plurality of circumferentially spaced apart openings for fluid communication with the fuel manifold;

wherein the nozzle body includes a plurality of tubes, a first set of the plurality of tubes connecting the first plurality of circumferentially spaced apart openings, a second set of the plurality of tubes connecting the second plurality of circumferentially spaced apart openings, wherein the first set of the plurality of tubes pass axially through a first group of the radial swirl vanes and the second set of the plurality of tubes pass axially through the first group of the radial swirl vanes, and wherein the second set of the plurality of tubes pass axially through the first fuel circuit; and an outer air passage defined between a fuel circuit outer wall of the second fuel circuit and an outer air passage wall, wherein the outer air passage is a converging non-swirling outer air passage.

14. The nozzle as recited in claim 13, wherein each tube in the second set of the plurality of tubes passes through a respective one of the tubes in the first set of the plurality of tubes.

* * * * *